US005665163A

United States Patent [19]

Li et al.

[11] Patent Number: 5,665,163

[45] Date of Patent: Sep. 9, 1997

[54] FILM APPLICATOR WITH ENTRAINED AIR REMOVAL AND SURFACE CONTROL

[75] Inventors: Alfred C. Li, Naperville, Ill.; Rex A. Becker, Janesville, Wis.; Leroy H. Busker, Rockton, Ill.

[73] Assignee: Beloit Technologies, Inc., Wilmington, Del.

[21] Appl. No.: 518,093

[22] Filed: Aug. 22, 1995

[51] Int. Cl.[6] ..... B05C 13/02

[52] U.S. Cl. ..... 118/413; 118/407; 118/409; 118/419

[58] Field of Search ..... 118/407, 409, 118/410, 413, 414, 411, 419

[56] References Cited

U.S. PATENT DOCUMENTS

| | | | |
|---|---|---|---|
| 4,009,657 | 3/1977 | Bonanno et al. . | |
| 4,357,370 | 11/1982 | Alheid | 427/211 |
| 4,558,658 | 12/1985 | Sommer et al. . | |
| 4,761,309 | 8/1988 | Embry | 427/294 |
| 4,839,201 | 6/1989 | Rantanen et al. | 427/355 |
| 4,860,686 | 8/1989 | Kato et al. | 118/410 |
| 4,873,939 | 10/1989 | Eskelinen . | |
| 4,961,968 | 10/1990 | Shands et al. | 427/356 |
| 4,964,364 | 10/1990 | Karna et al. . | |
| 5,183,691 | 2/1993 | Hassell et al. | 427/286 |
| 5,192,591 | 3/1993 | Chance | 427/356 |
| 5,199,991 | 4/1993 | Chance | 118/410 |
| 5,454,870 | 10/1995 | Sieberth . | |

FOREIGN PATENT DOCUMENTS

| | | |
|---|---|---|
| 0 436 172 A1 | 10/1991 | European Pat. Off. . |
| 42 05 993 A1 | 2/1992 | Germany . |
| 1 229 374 | of 0000 | United Kingdom . |
| WO 94/02256 | 2/1994 | WIPO . |
| WO 95/06164 | 3/1995 | WIPO . |

OTHER PUBLICATIONS

"BA 1500™ Coater: Versatile, high speed blade applicator produces quality coated papers,", a brochure by Beloit Corporation.

"New Coating Technologies Combine High Speeds With Higher Quality," an article published in *Pulp & Paper*, by Andy Harrison, pp. 60–64. May 1994.

*Primary Examiner*—Donald E. Czaja
*Assistant Examiner*—Steven B. Leavitt
*Attorney, Agent, or Firm*—Gerald A. Mathews; Dirk J. Veneman; Raymond W. Campbell

[57] ABSTRACT

A uniform film of coating is delivered onto a substrate at high speed by a film applicator, such as a coater apparatus for a papermaking machine, which has a static converging wedge, an adjustable converging wedge, and an extraction channel located between the two wedges. As a unit, the film applicator minimizes the hydrodynamic flow instabilities, as well as reduces flow variations associated with a nonuniform feed and a dynamic contact line. The film applicator also removes entrained air and excess coating from the application zone in order to improve the flow stability and machine runnability.

19 Claims, 6 Drawing Sheets

78
24
62
20
22
23
36

FILM APPLICATOR WITH ENTRAINED AIR REMOVAL AND SURFACE CONTROL

FIELD OF THE INVENTION

The present invention relates to apparatus for applying coatings to moving substrates such as paper, applicator rolls, felts, and blankets.

BACKGROUND OF THE INVENTION

Paper of specialized performance characteristics may be created by applying a thin layer of coating material to one or both sides of the paper. The coating is typically a mixture of a fine plate-like mineral, typically clay or particulate calcium carbonate; coloring agents, typically titanium dioxide for a white sheet; and a binder which may be of the organic type or of a synthetic composition. In addition, rosin, gelatins, glues, starches or waxes may be applied to paper for sizing.

Coated paper is typically used in magazines, commercial catalogs and advertising inserts in newspapers and other applications requiring specialized paper qualities.

Coated ground-wood papers include the popular designation "lightweight coated" (LWC) paper. For lightweight coated paper, coating weight is approximately thirty percent of total sheet weight and these grades of paper are popular with magazine publishers, direct marketers, and commercial printers as the lighter weight paper saves money on postage and other weight-related costs. With the increasing demand for lighter weight, lower cost coated papers, there is an increasing need for more efficiency in the production of these paper grades.

Paper is typically more productively produced by increasing the speed of formation of the paper and coating costs are kept down by coating the paper while still on the papermaking machine. Because the paper is made at higher and higher speeds and because of the advantages of on-machine coating, the coaters in turn must run at higher speeds. The need in producing lightweight coatings to hold down the weight of the paper and the costs of the coating material encourages the use of short dwell coaters for its superior runnability at high machine speeds.

Thus, high speed coater machines are key to producing lightweight coated papers cost-effectively.

Currently, coating applicators apply coating to the web in two separate manners. One is a direct application of a thin film by the coating applicator onto the moving web. The other is by application onto a transfer medium, i.e. an applicator roll, which then applies the thin film of fluid onto the web. Devices using either application approach may be classified as film applicators.

A typical film applicator has a coating pond which serves as an application zone. One of the boundary walls of the application zone is provided by the moving substrate, i.e. paper web or blanket supported by a backing roll, applicator roll, etc. Coating within the pond is effectively transferred onto the substrate. The substrate enters the pond through an overflow region where it makes initial contact with the coating fluid at the dynamic contact line. A boundary layer is rapidly established adjacent to the moving substrate as it propagates through the pond. The substrate exits the pond at a metering element. The pond provides a means for accelerating the coating fluid up to the speed of the moving substrate by allowing internal flow recirculation and attenuating the cross-machine direction flow variations by permitting overflow through the baffle. In general, the residence time is short for the substrate, but can be relatively long for the coating fluid.

The major problem associated with this type of film applicator is the appearance of uncontrollable, nonuniform cross-machine direction and machine direction coat weight distributions on the substrate as the machine speed exceeds some critical speed limit. This speed limit depends upon the flow geometry in the application zone and the rheological properties of the coating fluid. These non-uniformities exhibit a characteristic cross-machine length scale which appears to be proportional to the dimension characteristic of the active region where flow instabilities and disturbances take place.

Experimental data with a film applicator has revealed that the hydrodynamic instabilities induced by the presence of three-dimensional vortexes in the pond as well as flow disturbances created by the entrainment of air at the dynamic contact line and from the coating feed supply are important phenomena contributing to a nonuniform coat weight distribution. However, the relationship between these two phenomena is still unknown. When a fluid is driven away from its stable equilibrium mode due to a change in operating conditions, it will often undergo a sequence of instabilities, each of which leads to a change in the spatial or temporal structure in the flow. In the present case, hydrodynamic instabilities develop as a result of the coating fluid undergoing transitions of different dynamic regimes, such as shift from stable flow to an unstable flow as the Reynolds number (or machine speed) increases. The Reynolds number (Re) may be defined as:

$$Re = \frac{\rho L u}{\mu}$$

Where $\rho$ is the density of the coating fluid, u is the characteristic velocity (substrate speed), L is the characteristic dimension of the active region where the state of flow undergoes different dynamic changes, and $\mu$ is the apparent viscosity of the coating fluid. The stability of flow in the active region can influence the uniformity of velocity and pressure profiles that, in turn, affect the coat weight distribution on the substrate.

Although air entrainment has been the subject of research in a number of areas related to a moving substrate entering into or contacting with an unpressurized liquid system, it is apparent that even at a low machine speed, there is still a lack of fundamental understanding of how air is entrained at the dynamic contact line, how much air volume enters with the moving substrate, and where the entrained air goes. In general, any phenomenon observed at a low machine speed tends to be magnified and become even worse as the machine speed increases.

For the case of flow in a pressurized film applicator, the amount of air being entrained increases as the machine speed increases. At the same time, this same speed increase and the increased volume of air create flow disturbances in the coating pond, disrupting the uniformity of the velocity and pressure profiles as well as the desired boundary layer adjacent to the moving substrate. At lower machine speeds, most of the air is successfully displaced or removed via the overflow region. At faster machine speeds, however, an increasingly larger volume of air is forced out through the overflow or possibly underneath the metering blade. This combined action of flow instability and uncontrolled air removal results in the emergence of the coat weight variations on the substrate.

What is needed is a film applicator which is capable of operating consistently at high machine speeds and which minimizes coating defects.

SUMMARY OF THE INVENTION

The high speed film applicator of this invention is comprised of a static converging wedge, an adjustable converging wedge, and an extraction channel located between the two wedges. The static and adjustable converging wedges, whose dimensions and angles may vary due to application, define a region of decreasing height beneath the substrate. The geometry bounded by the static converging wedge, the adjustable converging wedge and the substrate minimizes flow variations due to a nonuniform coating feed and a nonuniform dynamic contact line profile. Subsequently, a stable flow is generated within the application zone. The adjustable converging wedge controls the applied coat weight by adjusting the width of the coating application gap within the pond. An extraction zone is positioned between the static and adjustable wedges, and vents to an atmospheric or partial vacuum pressure region. Coating is withdrawn from the pond at the extraction zone which reduces the mean pressure level in the application zone as well as attenuating the cross machine flow variations. Additionally, the extraction process removes air entrained in the coating fluid which results in improved coating flow stability.

It is a feature of this invention to provide an apparatus which applies coatings to a substrate traveling at high speeds with minimal surface variations.

It is another feature of the present invention to provide a film applicator which is insensitive to variations in coating flow and paper run.

It is also a feature of the present invention to provide a high speed film applicator which may be readily configured for different paper stocks and coater chemistry.

It is an additional feature of the present invention to provide a film applicator which damps high frequency and low frequency flow variations to yield improved coating attributes.

Further objects, features and advantages of the invention will be apparent from the following detailed description when taken in conjunction with the accompanying drawings.

DESCRIPTION OF THE PREFERRED EMBODIMENTS

Figure 1:
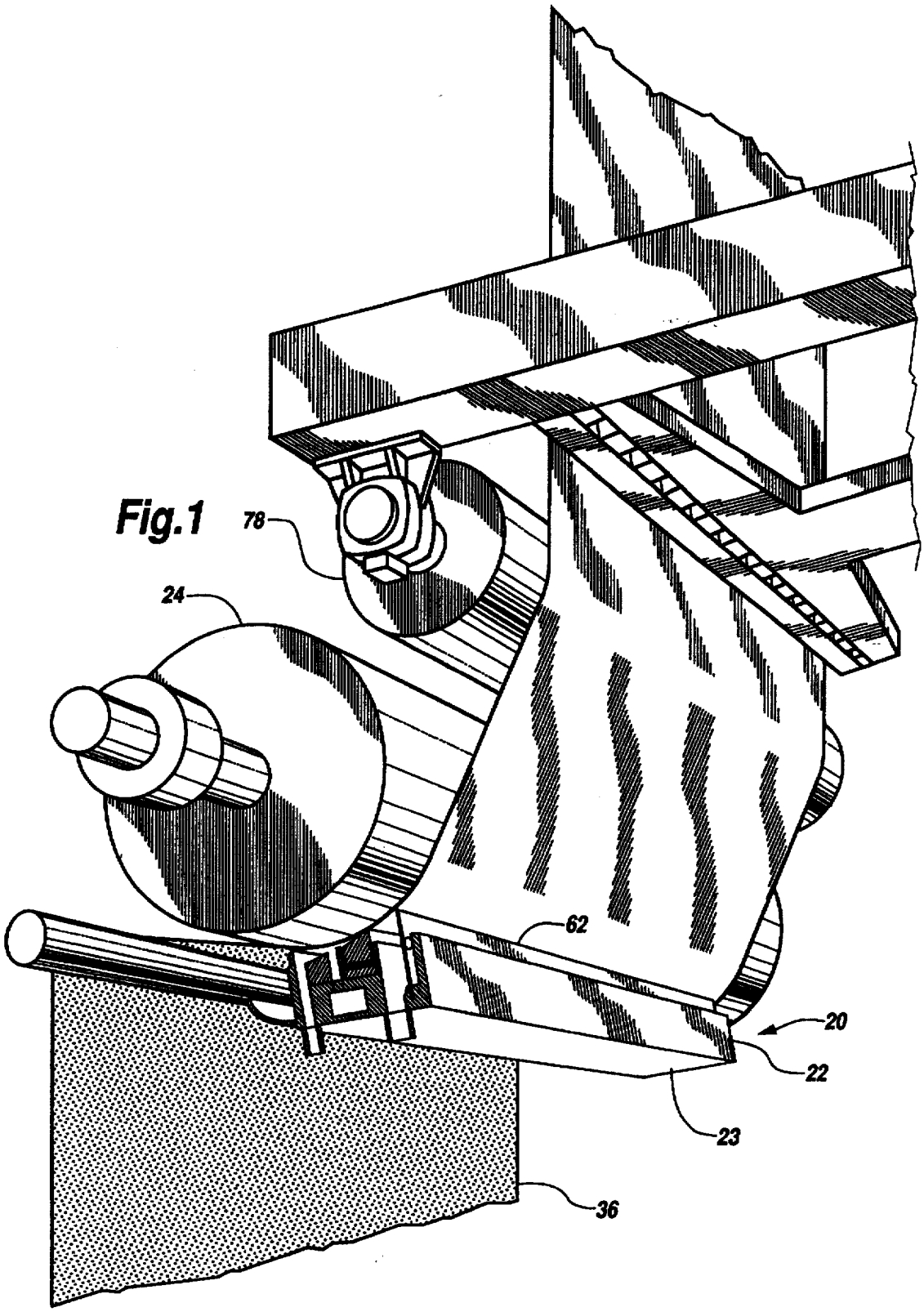
FIG. 1 is an isometric view of a high speed film coating applicator of this invention with a paper web proceeding therethrough.
Figure 2:
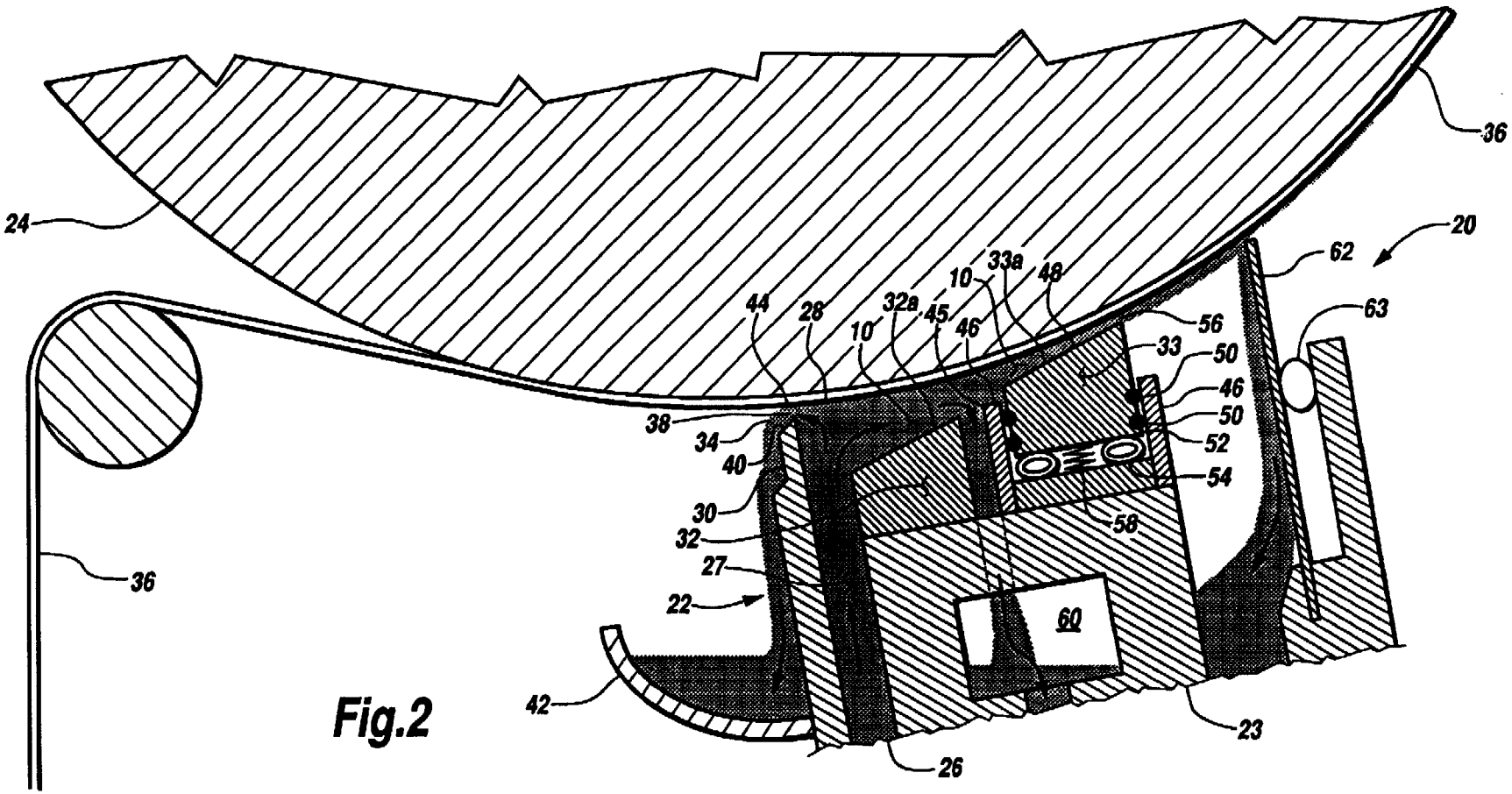
FIG. 2 is a cross-sectional elevational view of the applicator of FIG. 1.

Referring more particularly to FIGS. 1–6, wherein like numbers refer to similar parts, an applicator 20 for the application of coatings to a substrate moving at high speeds is shown in FIGS. 1 and 2. An uncoated substrate 36 passes through the applicator 20 for application of the desired surface coating. The applicator 20 has a coater head 22 which extends at least the width of the web and which is positioned beneath a backing roll 24. The coater head 22 has a rigid housing 23 which extends in the cross-machine direction and, with the surface of the substrate over the segment of the backing roll opposite the coater head housing, defines an application chamber 10 for applying coating to the substrate 36. The housing 23 has an inlet 26 through, with the surface of the substrate over the segment of the backing roll opposite the coater head housing, coating 34 is introduced to a pond 28 formed between a forward baffle plate 30 and an inclined static application wedge 32 and an adjustable application wedge 33. The region where coating is applied to the substrate in the application chamber over the static and adjustable application wedges is the application region for each such wedge and is the application region. Coating 34 is introduced under pressure from the inlet 26 to an inlet channel 27 from which it emerges into coating pond 28. The channel 27 is defined between the overflow baffle plate 30 and the static wedge 32, and preferably has a channel width of one-eighth to one-quarter inch. The depth of the channel is preferably from four to eight inches. The feed rate of the coating is preferably from one to four gallons-per-minute per cross-direction-inch.

The coating 34 is applied from the pond 28 to the substrate 36 which passes between the backing roll 24 and the coater head 22. A gap 38 is defined between the upper lip 40 of the baffle plate 30 and the substrate 36. The coating 34 overflows the baffle plate 30 and is allowed to escape the pond 28 through the gap 38. The gap 38 is between one-sixteenth and three-sixteenths of an inch high, and preferably about one-eighth of an inch high. The gap is used to vary the mean pressure in the pond, as well as to decrease the amount of air which is brought by the boundary layer of the substrate 36 into the pond 28. The overflow or flood of coating 34 which flows through the gap 38 displaces a portion of the air boundary layer. The overflow then flows into a trough 42 which is positioned upstream of the baffle plate 30. The overflowing coating 34 is collected in the trough 42 and recycled. A dynamic contact line 44 is formed where the coating 34 displaces the boundary layer of air adjacent to the substrate.

As shown in FIG. 2, the static wedge 32 is fixed to the housing 23 to present a constant inclined surface to the moving substrate 36. The static wedge 32 begins at the coating inlet 26 and extends upstream to an extraction zone channel 45 defined between the static wedge 32 and the adjustable wedge 33. The extraction channel 45 is preferably between zero and one-quarter inch in width, and is from one-half inch to five inches deep. The static wedge has a converging angle of up to fifteen degrees, and is preferably between three and fifteen degrees. This converging angle is formed between an application surface **32*a* on the static wedge and the surface of the substrate over the backing roll. The length of the static wedge 32** in the machine direction should be between one inch and five inches.

The adjustable converging wedge 33 is mounted downstream of the static wedge 32 and is resiliently mounted to the housing 23 for controlled movement toward and away from the moving substrate 36. The housing 23 has upstream and downstream restraining walls 46 which extend toward the substrate 36 on either side of the adjustable wedge 33. The restraining walls 46 do not extend above the upper surface 48 of the adjustable wedge 33. Two O-rings 50 are positioned between the sidewalls 52 of the adjustable wedge 33 and the housing restraining walls 46 to prevent flow therebetween.

The adjustable wedge 33 is supported on two inflatable members or air tubes 54 which extend in a cross-machine direction and which are loaded to achieve the desired application gap 56 between the downstream edge of the adjustable wedge 33 and the substrate 36. The application gap 56 is preferably between 0.001 inches and 0.100 inches. One or more springs 58 or other resilient means extend between the housing 23 and the adjustable wedge 33 to bias the adjustable wedge toward the housing. The adjustable wedge 33 is rigid in the cross-machine direction and is restrained in the machine direction. The loading of the air tubes 54 also holds the adjustable wedge 33 in a substantially constant vertical position with respect to the substrate 36, although a slight resilience in the loaded air tubes 54 may allow the wedge to cancel out vibrations in the machine. The air tubes 54 provide means for positioning the adjustable wedge member to adjust the height of the application gap.

Experiments have indicated that as the size of the application gap 56 increases, the flow uniformity through the gap becomes more responsive to changes in machine speed. The adjustable converging wedge 33 contributes to the development of a flow regime which approximates stable two-dimensional coating flow, thereby controlling the coat weight on the substrate. Through proper positioning of the adjustable wedge 33, the applicator 20 may be adjusted both between runs and on the run to obtain coating of consistent quality. If, for example, variations occur in the coating uniformity on the substrate during a run, it will be possible for an operator or an automatic controller to adjust the position of the adjustable wedge 33 to allow a greater or lesser flow rate of coating past the adjustable wedge. The final desired coat weight may be adjusted by controlling the pressure in the air tube 63 behind the metering blade 62. In a manner similar to the static wedge, the adjustable wedge has a converging angle of up to 15° and is preferably between 3° and 25° degrees. This converging angle is formed between an application surface 33*a* on the adjustable wedge and the surface of the substrate over the backing roll. The length of the adjustable wedge 33 in the machine direction is preferably between one inch and five inches.

The extraction zone channel 45 has a channel gap between the static wedge 32 and the downstream restraining wall 46 which may be up to one-quarter inch wide, and is preferably about one-eighth inch wide. The depth of the extraction zone channel 45 should be between one-half and five inches. The extraction zone channel 45 is connected to a recirculation chamber 60 or other region which is maintained at atmospheric pressure levels, or preferably the recirculation chamber is maintained at a pressure which may be above atmospheric but which is below the pressure levels experienced in the pond 28. The extraction zone is driven primarily by the pressure difference between the application zone and the atmosphere, and serves to eliminate a portion of the air entrained in the coating fluid for improving the flow stability. The extraction zone also serves to remove the excess coating within the pond 28 for minimization of the magnitude of the flow variations within the application, and for reduction of the mean pressure level in the application zone to enhance the applicator runnability.

Optionally, if application conditions require, a metering blade 62 may be provided to engage against the coated substrate 36 downstream of the adjustable wedge 33. Depending on the application, other metering devices, rods, air knifes, etc., can also be used. The heavily coated substrate 36 passes over the metering blade 62 where the majority of the coating is scraped away leaving a uniform layer of coating on the substrate. The removed coating 34 may be collected and recirculated. An air tube 63 extends between the housing 23 and the metering blade 62 and allows for control of the position of the metering blade with respect to the substrate 36. The coated substrate 36 then leaves the backing roll 24 and passes over a turning roll 78 and enters a dryer section (not shown).

The applicator 20 is thus provided with structure which contributes to a determined and predictable flow of coating. By limiting the coating flow to a two-dimensional type flow as far as possible, the vortexes and other flow disturbance effects which mar consistent coating are minimized. In general, the applicator reduces the capacity for the fluid flow to determine its own flow path, but constrains the coating to flow along a desired route.

Figure 3:
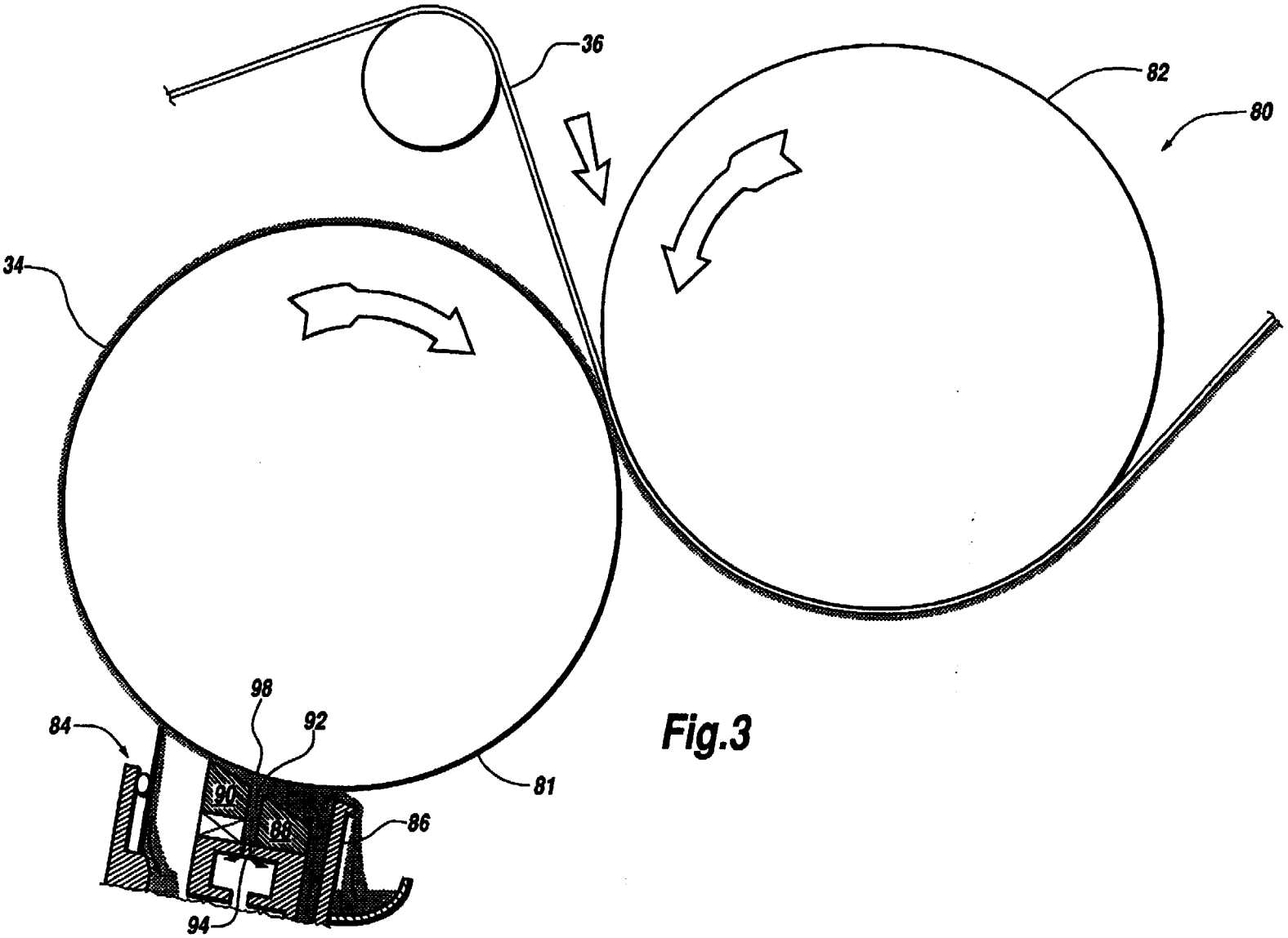
FIG. 3 is a schematic representation of an applicator of this invention having two solid wedges, the second wedge being adjustable, separated by an extraction path, and illustrated in a size applicating embodiment.

An alternative embodiment film applicator 80 is shown schematically in FIG. 3. The film applicator 80 illustrates a size applicating embodiment of the applicator of this invention. The applicator 80 has size roll 81, to which the coating is directly applied, and a backing roll 82 over which the web 36 is guided. A coater head 84 has a housing 86 to which is mounted a static wedge 88 which is spaced from an adjustable wedge 90 to define an extraction zone channel 92. The static wedge 88 and adjustable wedge 90 may be similar to those of the applicator 20. The adjustable wedge 90 is shown schematically as a block, to indicate that a variety of adjustable wedge mechanisms, such as those described below, may be employed. In FIG. 3, the adjustable wedge can vary the gap width with proper control mechanisms. Coating is transferred from the size roll to the web 36 guided by the backing roll. The applicator 80 has a valve, or other means for restricting the flow which is positioned beneath the extraction zone channel 92. By opening or closing the flow restricting means 94, the flow rate from the extraction zone channel 92 may be controlled. Closing of the flow restricting means 94 will reduce the outflow of coating from the pond 98. Opening the flow restricting means will increase the outflow of coating. The flow restricting means may be a member which is movable toward and away from the channel 92 to adjust the flow characteristics.

Figure 4:
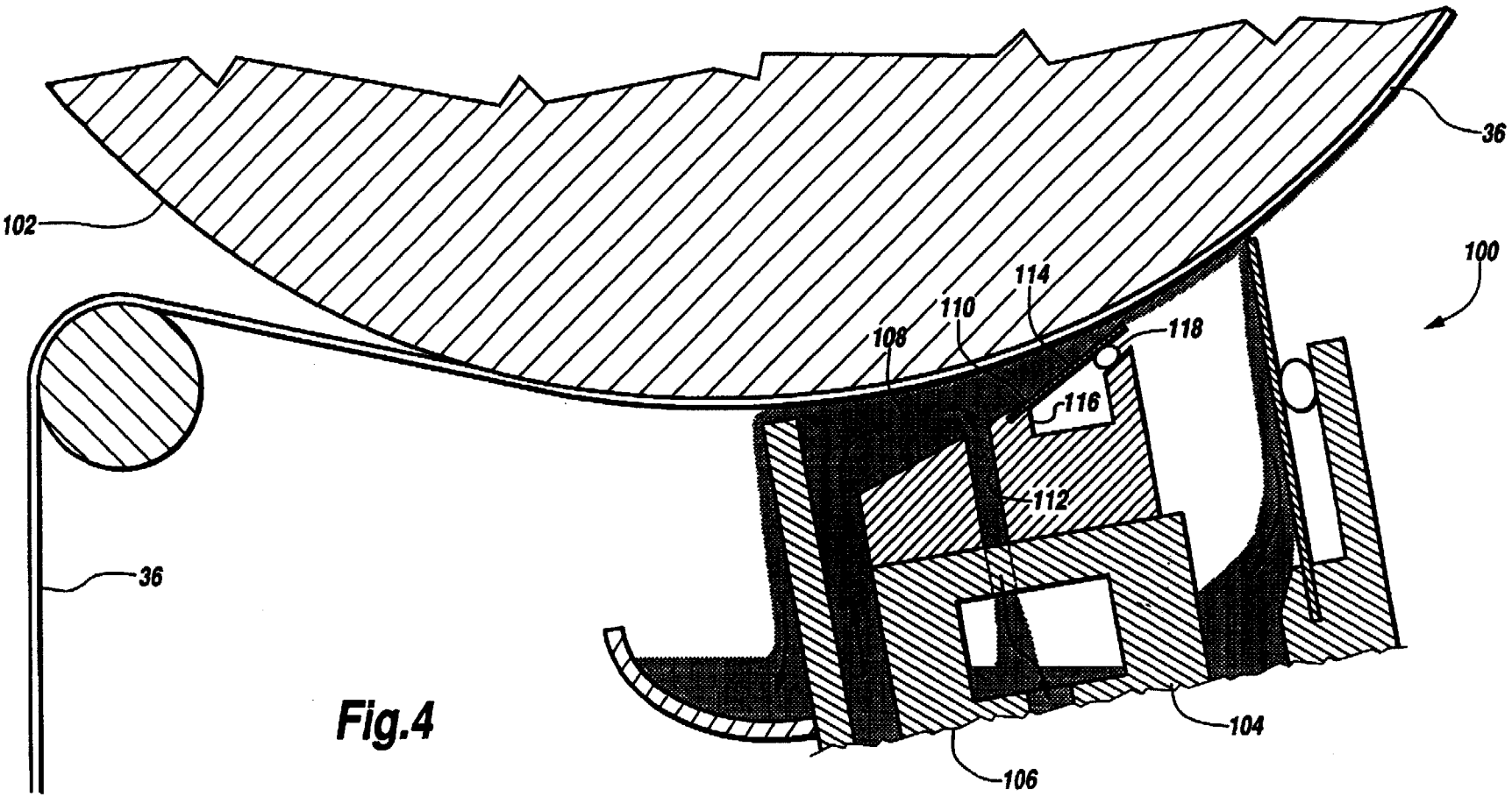
FIG. 4 is a cross-sectional view of an alternative embodiment applicator of this invention having a dynamic wedge defined by a metal blade.
Figure 5:
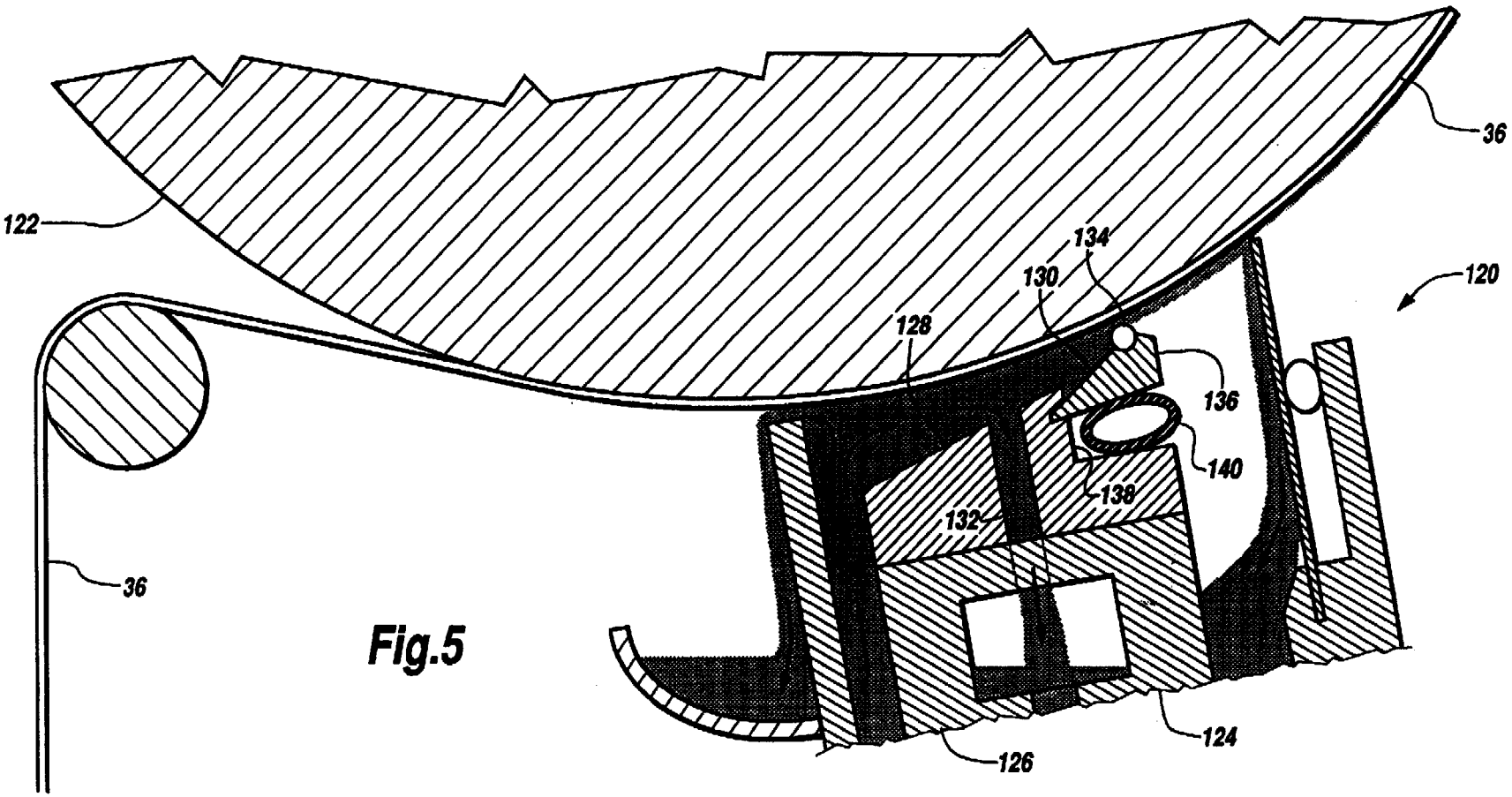
FIG. 5 is a cross-sectional view of another alternative embodiment applicator of this invention having an adjustable wedge with a rod arrangement.
Figure 6:
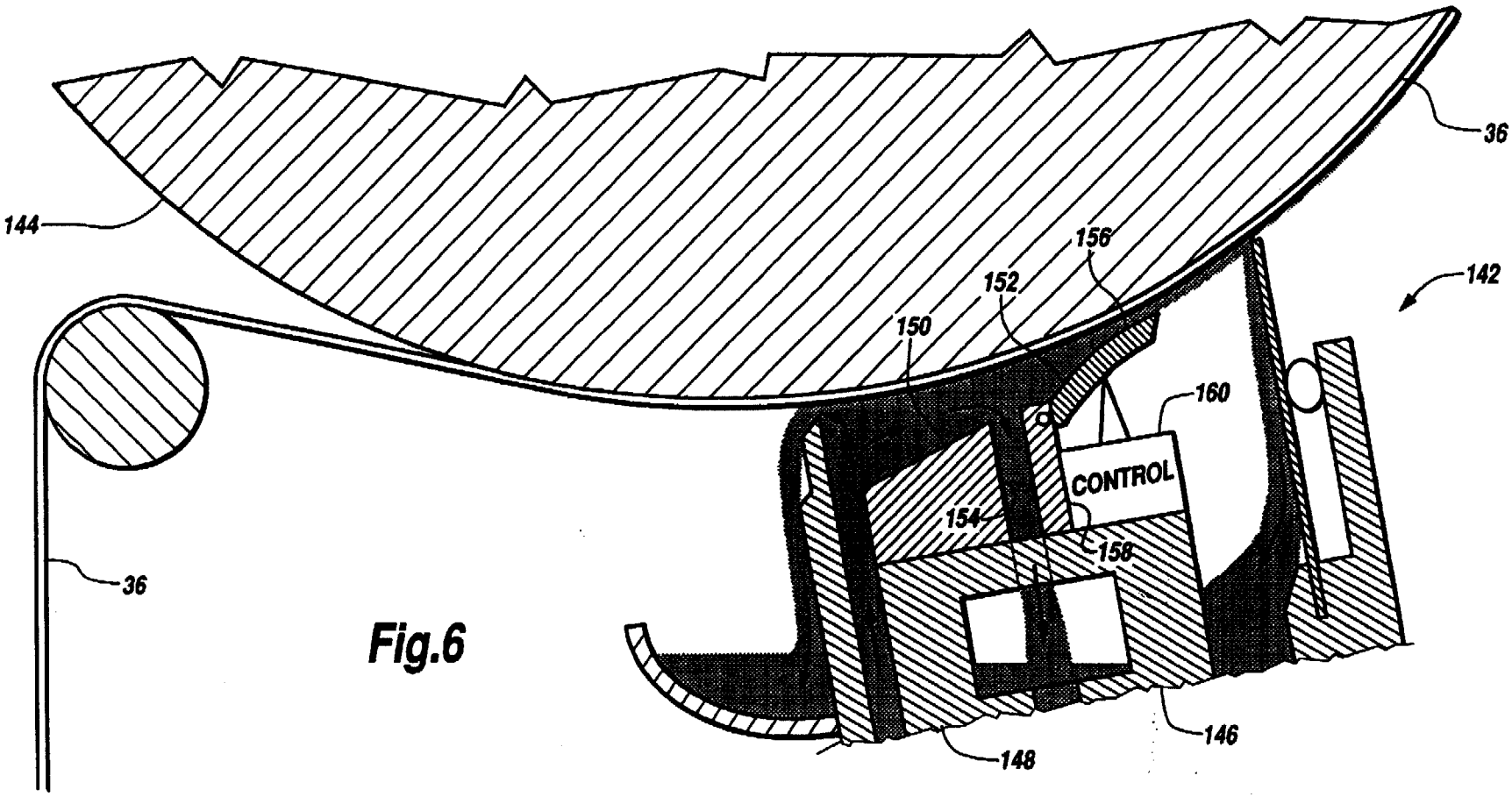
FIG. 6 is a cross-sectional view of a further alternative embodiment applicator of this invention having an adjustable wedge defined by a rigid member with active loading and retracting structures.

Alternative adjustable wedge structures are shown in the applicators of FIGS. 4–6. The alternative embodiment applicator 100, shown in FIG. 4, has a backing roll 102 and a coater head 104 with a housing 106 positioned beneath the backing roll 102. A static wedge 108 is fixed to the housing 106, and an adjustable wedge 110 is spaced downstream from the static wedge 108 and is separated from the static wedge by an extraction zone channel 112. The adjustable wedge 108 is comprised of a flexible metal blade 114 which is fixed at one end to a post 116, and which is deflectable by an inflatable tube 118. The blade 114 is either in a low angle mode or a bent mode. The blade functions as an adjustable wedge and is adjustable by selected pressurization of the tube 118 to meet coating requirements.

Another alternative applicator 120 is shown in FIG. 5. The applicator 120 has a backing roll 122 and a coater head 124 with a housing 126 positioned beneath the backing roll 122. A static wedge 128 is fixed to the housing 126, and an adjustable wedge 130 is spaced downstream from the static wedge 128 and is separated from the static wedge by an extraction zone channel 132. The adjustable wedge 130 is comprised of a stationary or rotatable roller 134 mounted to a support 136 which is pivotably mounted at its upstream edge to a post 138. The roller may be forward or reverse rotating, and may be either smooth or provided with circumferential grooves. The diameter of the roller 134 is preferably between three-eighths of an inch and two inches in diameter. The support 136 is backed by an inflatable tube 140 which is filled to a desired loading level. The tube 140 is sealed and is expanded with increased pressure in the tube to thereby decrease the gap between the roller 134 and the substrate 36.

Yet another alternative embodiment applicator 142 is shown in FIG. 6. The applicator 142 has a backing roll 144 and a coater head 146 with a housing 148 positioned beneath the backing roll 144. A static wedge 150 is fixed to the housing 148, and an adjustable wedge 152 is spaced upstream from the static wedge 150 and is separated form the static wedge by an extraction zone channel 154. The adjustable wedge 152 is comprised of a rigid plate 156 which is pivotably mounted to a post 158. The plate may be planar or, as shown, may have a slight curve formed therein. The plate may be convex toward the substrate to promote smooth flow thereover. A control mechanism 160, shown schematically, is any conventional position control mechanism for adjustably positioning the plate at a desired angle. The control mechanism has sophisticated loading and retracting mechanisms, and may be responsive to sensors to position the rigid plate 156 at a desired angle. The control mechanism may be pneumatic or hydraulic actuators, piezoelectric actuators, electrically adjustable ferrous iron actuators, linkage actuators or other control mechanisms.

It should be noted that, in certain applications, it may be desirable to close up the extraction zone channel entirely where extraction of entrained air and excess coating is not required, for example where machine speed is low, or where coating formulations with low solids content or low viscosity levels are employed. Furthermore, although the apparatus of this invention has been illustrated in a web coating application, a similar apparatus may be employed for coating an application roll in a size press application.

It is understood that the invention is not limited to the particular construction and arrangement of parts herein illustrated and described, but embraces such modified forms thereof as come within the scope of the following claims.

We claim:

1. A coater apparatus for applying coating material to a traveling substrate guided by a backing roll, said apparatus comprising:

an applicator comprising a coater head housing disposed in close proximity to the backing roll such that the substrate guided by the backing roll moves between the backing roll and the coater head housing, wherein the coater head housing and the proximate opposed portion of the substrate over the backing roll defines an application chamber which opens toward the substrate and which extends along the substrate in the cross-machine direction, and wherein the application chamber receives and retains coating material, and wherein the application chamber is connected to a source of coating material;

portions of the coater head housing define a baffle plate upstream of the application chamber, wherein the baffle plate has portions defining a lip spaced from the backing roll, and wherein excess coating material within the application chamber overflows the baffle plate lip to escape the application chamber;

a static wedge member within the application chamber fixedly mounted to the housing, and which defines an application region between the static wedge member and the substrate, and wherein the static wedge member has an application surface which more closely approaches the substrate as the static wedge member extends downstream, in the direction of substrate travel, and wherein the application surface is substantially fixed with respect to the housing; and an adjustable wedge member within the application chamber moveably mounted to the housing, and which defines an application region between the adjustable wedge member and the substrate, downstream of the static wedge member, wherein the adjustable wedge member has an application surface which more closely approaches the substrate as it extends downstream defining an application gap of a variable height between the substrate and the application surface, and wherein the adjustable wedge member is resiliently connected to the housing.

2. The apparatus of claim 1 wherein the adjustable wedge member has a converging angle of between three and fifteen degrees.

3. The apparatus of claim 1 wherein the adjustable wedge member has a length in the machine direction of between one inch and five inches.

4. The apparatus of claim 1, further including:

a low pressure chamber for being retained at a pressure below that of the coating within the application chamber, wherein the low pressure chamber connects with the application chamber through an extraction zone channel defined between the static wedge member and the adjustable wedge member, wherein air and excess coating are drawn out of the application chamber to the lower pressure chamber.

5. The apparatus of claim 1 further comprising:

an upstream wall extending from the housing;

a downstream wall extending from the housing, wherein the adjustable wedge member is engaged between the upstream wall and the downstream wall for movement toward and away from the substrate; and at least one inflatable member which extends between the housing and the adjustable wedge, wherein the inflatable member may be inflated to position the adjustable wedge as desired.

6. The apparatus of claim 1, wherein the adjustable wedge member comprises:

a metering means connected at one end thereof to the adjustable wedge member; and an inflatable member extending between the adjustable wedge member and the metering means, wherein the inflatable member may be adjusted to position the metering means as desired relative to the substrate over the backing roll.

7. The apparatus of claim 6, wherein:

the metering means comprises an application roller which extends in the cross-machine direction, the roller being engagable with the moving substrate.

8. The apparatus of claim 1 wherein the adjustable wedge member comprises:

a rigid member having an application surface; and means for positioning the rigid member with respect to the housing.

9. The apparatus of claim 8 wherein the application surface is convex toward the substrate.

10. The apparatus of claim 1 further comprising a metering element located on the coater head housing which engages the coated substrate downstream of the adjustable wedge member and removes a portion of the coating thereon.

11. The apparatus of claim 1, wherein:

the coater head housing further includes a coating pond located upstream of the static application wedge application region and open to the substrate over the backing roll:

an inlet channel disposed in the coater head housing, the inlet channel in fluid communication between an inlet, for receiving coating material from outside the coater head housing, and the coating pond:

whereby the coating is fed through the coating pond at a location upstream of the static wedge member.

12. A coater for applying a coater material to a traveling substrate, the coater comprising:

a backing roll which engages the substrate to be coated;

an applicator, comprising a coater head housing closely spaced from the substrate and the backing roll, wherein the housing defines, with the substrate, an application chamber, which opens towards the substrate and which extends along the substrate in the cross-machine direction, for receiving coating material under pressure;

a static wedge member fixed to the coater housing within the application chamber, wherein the static wedge member extends towards the substrate to define a wedge-shaped application region of the application chamber;

an adjustable wedge member which is moveably connected to the coater head housing within the application chamber downstream of the static wedge member, wherein the adjustable wedge member has an application surface which more closely approaches the substrate as it extends downstream, and which defines an application gap of a selectively variable height between the substrate and the application surface;

means for positioning the adjustable wedge member to adjust the height of the application gap;

an extraction zone channel defined between the static wedge member and the adjustable wedge member for receiving coating material from the application chamber; and chamber means within the housing which define a low pressure region for being maintained at a pressure below that of the coating within the application chamber, wherein entrained air and coating within the application chamber are drawn from the application chamber, through the extraction zone channel and into the chamber means.

13. The apparatus of claim 12 further comprising:

an upstream wall extending from the housing; and a downstream wall extending from the housing, wherein the adjustable wedge member is engaged between the upstream wall and the downstream wall for movement toward and away from the substrate; and wherein the means for positioning the adjustable wedge member comprises at least one inflatable member which extends between the housing and the adjustable wedge, wherein the inflatable member may be inflated to position the adjustable wedge as desired.

14. The apparatus of claim 12, wherein:

the adjustable wedge member includes an adjustable member connected at one end thereof to the housing, and wherein the means for positioning comprises an inflatable member extending between the housing and the adjustable member, wherein the inflatable member may be adjusted to position the adjustable member as desired.

15. The apparatus of claim 14 wherein a coating application roller is mounted to the adjustable member and extends in a cross-machine direction, the roller being engageable with the moving substrate.

16. The apparatus of claim 12 further comprising a metering blade which engages the coated substrate downstream of the adjustable wedge member and removes a portion of the material thereon.

17. The apparatus of claim 12 wherein the material is fed to the application chamber at a location in the coater head housing upstream of the static wedge member.

18. A coater apparatus for applying coating material to a traveling substrate guided by a backing roll, said apparatus comprising:

an applicator, comprising a coater head housing disposed in close proximity to the backing roll such that the substrate guided by the backing roll moves between the backing roll and the coater head housing, wherein the housing and the opposed substrate defines an application chamber which is open toward the substrate and which extends along the substrate in the cross-machine direction, and wherein the application chamber receives and retains coating material, and wherein the application chamber is connected to a pressurized source of coating material;

portions of the coater head housing define a baffle plate upstream of the application chamber, wherein the baffle plate has portions defining a lip spaced from the backing roll, and wherein excess coating material within the application chamber overflows the baffle plate lip to escape the application chamber;

a static wedge member within the application chamber fixed to the coater head housing and which defines, with the opposed substrate, an application chamber between the static wedge member and the substrate, wherein the static wedge member has an application surface which more closely approaches the substrate as the static wedge member extends downstream, and wherein said application surface is substantially fixed with respect to the housing;

an adjustable wedge member moveably connected to the coater head housing downstream of the static wedge member, and which defines with the opposed substrate, an application chamber wherein the adjustable wedge member has an application surface which more closely approaches the substrate as it extends downstream and defines an application gap of a selectively variable height between the web and the application surface; and means for adjusting the position of the adjustable wedge member to control the height of the application gap.

19. The apparatus of claim 18 further including a low pressure chamber for being retained at a pressure below that of the coating within the pond, wherein the low pressure chamber connects with the coating pond through an extraction zone channel defined between the static wedge member and the adjustable wedge member, and wherein air and excess coating are drawn out of the pond to the low pressure chamber.

* * * * *